US010850186B2

(12) United States Patent
Chung

(10) Patent No.: US 10,850,186 B2
(45) Date of Patent: Dec. 1, 2020

(54) GAMING APPARATUS AND A METHOD FOR OPERATING A GAME

(71) Applicant: In Hing Gordon Chung, Happy Valley (HK)

(72) Inventor: In Hing Gordon Chung, Happy Valley (HK)

( * ) Notice: Subject to any disclaimer, the term of this patent is extended or adjusted under 35 U.S.C. 154(b) by 0 days.

(21) Appl. No.: 16/051,583

(22) Filed: Aug. 1, 2018

(65) Prior Publication Data

US 2020/0038743 A1 Feb. 6, 2020

(51) Int. Cl.
*A63F 9/02* (2006.01)
*A63F 9/24* (2006.01)

(52) U.S. Cl.
CPC ..... *A63F 9/0208* (2013.01); *A63F 9/24* (2013.01); *A63F 2009/0221* (2013.01); *A63F 2009/2435* (2013.01); *A63F 2009/2458* (2013.01)

(58) Field of Classification Search
CPC ..... F41J 3/02
See application file for complete search history.

(56) References Cited

U.S. PATENT DOCUMENTS 6,147,759 A * 11/2000 Simmons ..... F41J 3/00 250/222.1
2005/0023763 A1* 2/2005 Richardson ..... A63F 13/10 273/348
2005/0153785 A1* 7/2005 Sun ..... A63B 24/0003 473/151
2005/0227792 A1* 10/2005 McCreary ..... A63B 24/0003 473/409
2006/0160639 A1* 7/2006 Klein ..... A63B 71/0669 473/476
2008/0312010 A1* 12/2008 Marty ..... A63B 24/0003 473/447
2010/0137079 A1* 6/2010 Burke ..... H04N 7/183 473/446
2011/0053688 A1* 3/2011 Crawford ..... A63D 5/04 463/31
2014/0151965 A1* 6/2014 Garas ..... F41J 5/06 273/371
2014/0206479 A1* 7/2014 Marty ..... A63B 69/3623 473/447
2015/0290536 A1* 10/2015 Schumacher ..... A63F 13/35 463/7
2015/0308793 A1* 10/2015 Hong ..... F41J 3/02 273/371
2016/0358406 A1* 12/2016 Daly ..... G07F 17/32
2016/0370155 A1* 12/2016 Dale ..... F41J 3/02
2017/0167832 A1* 6/2017 Hong ..... F41J 3/00
2017/0246543 A1* 8/2017 Dawe ..... A63B 24/0021
2017/0326444 A1* 11/2017 Hong ..... A63F 9/02
2017/0370682 A1* 12/2017 Hong ..... A63F 13/46
2018/0238662 A1* 8/2018 Oh ..... F41J 5/14
2018/0247421 A1* 8/2018 DeAngelis ..... G01S 1/042
2018/0318715 A1* 11/2018 Dawe ..... A63F 13/213

* cited by examiner

*Primary Examiner* — Reginald A Renwick
(74) *Attorney, Agent, or Firm* — Renner Kenner Greive Bobak Taylor & Weber

(57) ABSTRACT

A gaming apparatus including a tracking system arranged to track at least one position of a user delivered projectile; and a processing unit for receiving tracking data detected by the tracking system to generate projectile data representative of a path of the user delivered projectile.

32 Claims, 9 Drawing Sheets

GAMING APPARATUS AND A METHOD FOR OPERATING A GAME

TECHNICAL FIELD

The present invention relates to a gaming apparatus and a method for operating a game and particularly, although not exclusively, to a gaming apparatus for a throwing game and a method for operating a throwing game.

BACKGROUND

Adults and children enjoy the challenges of playing games. More recently, since the computer age, many traditional games played throughout the ages by adults and children have been computerized, often in the form of a computer game being played on a screen via a controller.

However, physical games, including games that are played in person or involve physical activity are nonetheless irreplaceable as they involve skill and dexterity that may not be applicable to computer games. One such suite of games includes activity games where a player must be physically active to actually play the game.

The difficulty with physical games is that many of these games have not evolved around digitalization. That is, although various technologies are available in computer gaming, these technologies are not specifically made to enhance the physical game itself, but rather the digitalization or use of virtual reality to adapt to the game play. Such computerization would only appeal to certain aspects of the game play but will remove the physical element from the game itself. The result is that garners often fall into two groups, those who enjoy computer games, or those that enjoy physical games, with garners of different groups not showing much enthusiasm for the other group.

SUMMARY OF THE INVENTION

In accordance with a first aspect of the present invention, there is provided a gaming apparatus comprising:

a tracking system arranged to track at least one position of a user delivered projectile; and, a processing unit for receiving tracking data detected by the tracking system to generate projectile data representative of a path of the user delivered projectile.

In an embodiment of the first aspect, the tracking system includes a projectile tracking system to track at least one position of projectile after user delivery.

In an embodiment of the first aspect, the projectile tracking system includes a sensing module to detect at least one position of the projectile after user delivery.

In an embodiment of the first aspect, the projectile tracking system includes a camera module to capture image of the projectile in at least one position after user delivery.

In an embodiment of the first aspect, the sensing module includes a plurality of sensing units.

In an embodiment of the first aspect, the plurality of sensing units is optical sensing units.

In an embodiment of the first aspect, the optical sensing units include at least one of a color sensor and/or an infrared sensor.

In an embodiment of the first aspect, the sensing module detects at least one position of the projectile after user delivery by tracking a color mark on the projectile.

In an embodiment of the first aspect, the sensing module detects at least one position of the projectile after user delivery by reading an infrared signal from the projectile.

In an embodiment of the first aspect, the sensing module detects at least one position of the projectile after user delivery by computer aided object recognition.

In an embodiment of the first aspect, the camera module includes a plurality of camera units to capture image of the projectile in at least one position after user delivery in response to the infrared signal received by the sensing module.

In an embodiment of the first aspect, the tracking system includes a tracking camera module to detect and capture images of the projectile in at least one position after user delivery.

In an embodiment of the first aspect, the tracking camera module includes a plurality of motion camera units.

In an embodiment of the first aspect, the gaming apparatus further comprises a gaming platform arranged for the user/gamer/player to deliver projectiles thereon.

In an embodiment of the first aspect, the projectile tracking system is arranged to be mounted on at least one cantilever adjacent to the gaming platform.

In an embodiment of the first aspect, the projectile tracking system is mounted on at least one pole adjacent to an oche.

In an embodiment of the first aspect, the sensing module and the camera module of the projectile tracking system mounted on at least one cantilevers are adapted to be rotatable or movable along a rail extended from the cantilevers.

In an embodiment of the first aspect, the sensing module or the camera module of the projectile tracking system mounted on at least one pole of the oche are adapted to be rotatable.

In an embodiment of the first aspect, the processing unit is arranged to perform a facial recognition procedure of the user.

In an embodiment of the first aspect, the processing unit predetermines the path of the projectile based on a user's habit and usual game route.

In an embodiment of the first aspect, the processing unit is further arranged to process the projectile data to determine a user's gaming score.

In an embodiment of the first aspect, the processing unit is further arranged to capture images of the user.

In an embodiment of the first aspect, the user's identity is further processed with the images of the user to determine the user's usual gaming strategy.

In an embodiment of the first aspect, the user gaming strategy includes: a determined common path of the projectile based on the rules to play any given game, a determined user habit, or any one thereof.

In an embodiment of the first aspect, the gaming apparatus further comprises a communication gateway to communicate with other gaming apparatuses or multimedia devices.

In an embodiment of the first aspect, the communication gateway is arranged to communicate with other gaming apparatuses or multimedia devices to operate a multi-player game with the other gaming apparatuses or multimedia devices.

In an embodiment of the first aspect, the communication gateway communicates the projectile data representative of the path of the user delivered projectile to other gaming apparatuses or multimedia devices.

In an embodiment of the first aspect, the communication gateway communicates images of the projectile or images of the user to other gaming apparatuses or multimedia devices.

In an embodiment of the first aspect, the user delivered projectile includes a dart, ball, disc, ring, stick, bolt or any one or more thereof.

In an embodiment of the first aspect the tracking system includes a projectile tracking system to track the at least one position of projectile before or after user delivery.

In an embodiment of the first aspect the projectile tracking system includes a camera module arranged to capture one or more images of the projectile in the at least one position before or after user delivery.

In an embodiment of the first aspect the projectile tracking system further includes a sensing module to detect the at least one position of the projectile before or after user delivery.

In an embodiment of the first aspect the sensing module includes at least one of a colour sensor or an infrared sensor arranged to determine the at least one position of the projectile.

In an embodiment of the first aspect the one or more images of the projectile are processed by the processing unit to determine the at least one position of the projectile.

In an embodiment of the first aspect the colour sensor determines the at least one position of the projectile by tracking a colour mark on the projectile.

In an embodiment of the first aspect the infrared sensor determines at least one position of the projectile by tracking an infrared signal from the projectile.

In an embodiment of the first aspect the camera module is controlled to capture images of the projectile before or after user delivery.

In an embodiment of the first aspect the processing unit is arranged to use the at least one position of the projectile to control the camera module.

In an embodiment of the first aspect the processing unit is further arranged to predict at least one predicted position of the projectile.

In an embodiment of the first aspect, the processing unit uses the at least one predicted position of the projectile to control the camera module to capture the images of the projectile.

In an embodiment of the first aspect the at least one predicted position of the projectile is determined by the at least one position of the projectile as detected by the sensing unit, camera module, game play data associated with the user or any one or more thereof.

In an embodiment of the first aspect the camera module includes a plurality of motion camera units, each arranged to be controlled by the processing unit to continuously capture the images of the projectile.

In an embodiment of the first aspect, the system further comprises a gaming platform arranged for the user to deliver projectiles thereon.

In an embodiment of the first aspect the processing unit is arranged to predetermine the path of the projectile based on a user's habit and/or usual game route.

In accordance with a second aspect of the present invention, there is provided a method for operating a game comprising the steps of: tracking a projectile delivered by a player to determine a gaming result; and storing the gaming result.

In an embodiment of the second aspect, the method further includes a step of identifying the player.

In an embodiment of the second aspect, the identity of the player and the gaming result is communicated to other players in a multi-player game.

In an embodiment of the second aspect, the step of tracking the projectile is performed by a camera module arranged to capture images of the projectile.

In an embodiment of the second aspect, the step of identifying the player is performed by the camera module further arranged to capture images of the player.

In an embodiment of the second aspect, the images of the projectile and the player are communicated to other players in the multi-player game.

In an embodiment of the second aspect, the camera module is arranged to be controlled to focus on the projectile so as to capture the images of the projectile.

In an embodiment of the second aspect, the camera module is controlled with use of a predicted position of the projectile.

BRIEF DESCRIPTION OF THE DRAWINGS

Embodiments of the present invention will now be described, by way of example, with reference to the accompanying drawings in which.

DETAILED DESCRIPTION

Figure 1:
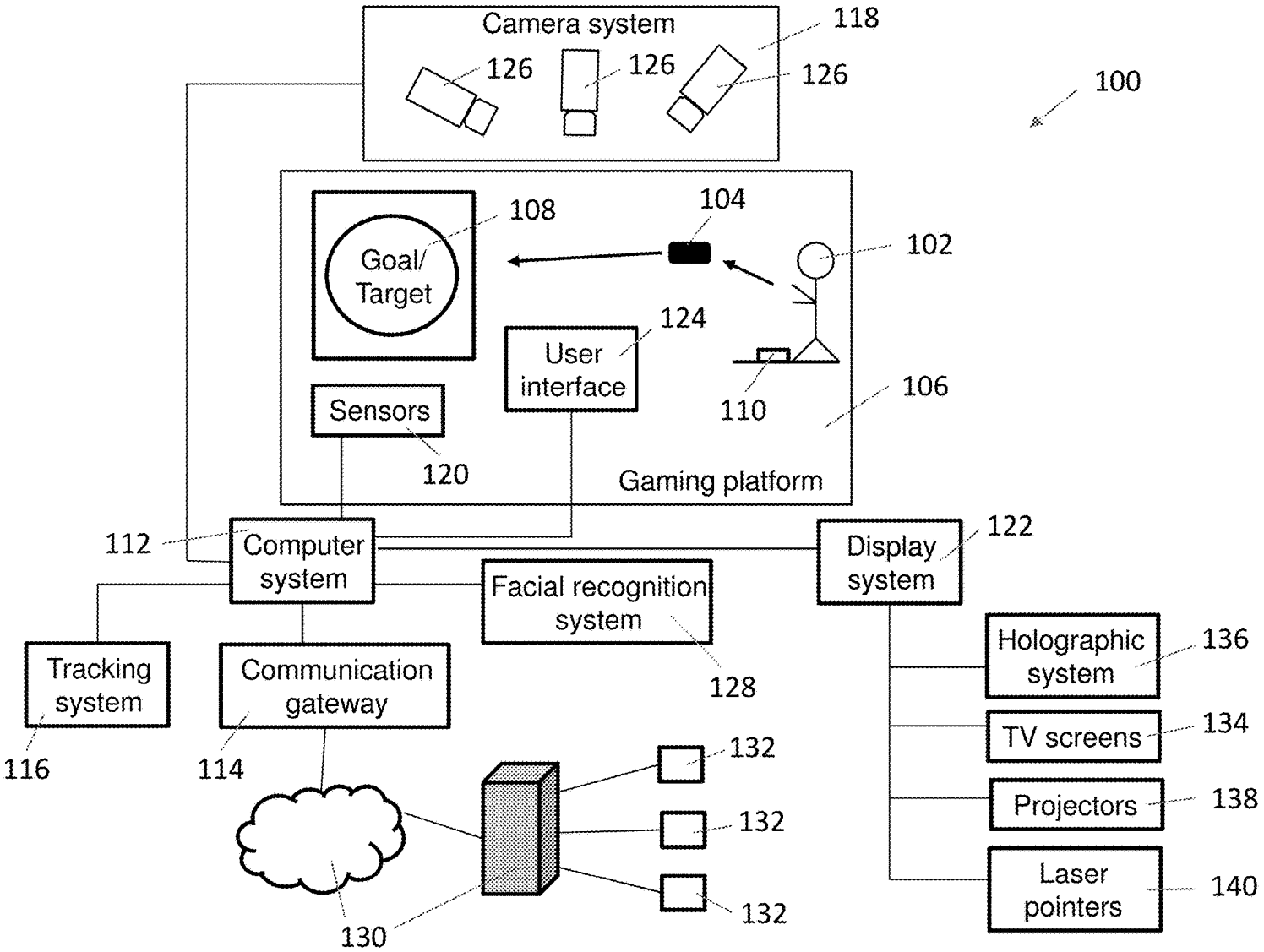
FIG. 1 is a block diagram of a gaming apparatus in accordance with one embodiment of the present invention.

With reference to FIG. 1, there is shown a block diagram of a gaming apparatus comprising:

- a tracking system arranged to track at least one position of a user delivered projectile;
- a processing unit for receiving tracking data detected by the tracking system to generate projectile data representative of a path of the user delivered projectile.

In this embodiment, the gaming apparatus 100 is arranged to provide a gaming function whereby a user or player 102 is able to participate in a game, sport or activity. Such a game, sport or activity may be at least partially physical, that is, it would require the player 102 to undertake certain actions, including and without limitations throwing, kicking, punching, shooting, manipulating or otherwise delivering an object 104.

In this example embodiment, the gaming apparatus 100 includes a gaming platform 106 whereby a user or player 102, is able to play a throwing game or participate in throwing sports. A throwing game, at least as described herein, may include any type of game, task, activity, challenge or sport whereby a user or player 102 would throw, kick, punch, launch, shoot, squirt, or otherwise deliver an object or liquid 104 towards a target or goal area 108. This target or goal 108 may be a physical target, or a virtual target generated on a screen or holographic display, or a combination of both.

The game may also have an outcome being associated with or related to the ability of the user 102 or manner in which the user or player 102 throws, kicks, punches, shoots, blows, launches or otherwise delivers the object or liquid 104. This may be measured by various attributes, including, but not limited to, the distance, accuracy, speed or projectile path of the object 104 from when the user 102 throws or delivers the object 104 to the target or goal 108 in which the object 104 is thrown or delivered to, or the number of objects 104 thrown, kicked, punched or otherwise delivered within a predetermined time frame. Such throwing games may include, without limitations, darts, bowling, pitching of a ball or object, flicking of cards, stars, discs or other planar objects, tossing of objects, throwing of balls, darts, stars, weighted items, spears, axe and hammers. For the purposes of this specification, the term throwing games or throwing sports may also include user delivered projectile games, activities or sports, including the firing or delivery of an arrow, bolt, bullet, pellet, ball bearing, liquid, air, ball or object from a bow, crossbow, airgun, air-soft fun, BB gun, gun, cannon, slingshot, club, bat etc.

As indicated in FIG. 1, the throwing game may be played on a gaming platform 106 by a player 102 of the game. In this example, the gaming apparatus 100 includes a gaming platform 106 to allow the user 102 to play the throwing game by throwing or otherwise delivering a projectile 104 towards a goal or target 108. Such a game, may be, for example, a dart game where a player 102 would throw darts 104 from behind an oche 110 with the darts 104 being thrown towards a dart board 108. In such a game, points may be awarded when the dart 104 lands onto particular parts of the dart board 108 and specific turns may be determined based on the rules of the game.

In this example embodiment shown, the gaming apparatus 100 also includes a computing system or computer 112, which may be any computing device with a processor (CPU), memory, storage and networking interfaces which is arranged to operate as a computer or computer server and may communicate with an external computing server or cloud based server via a connection with a communication network (e.g. internet, intranet, telephone network, cellular network etc). Such computing devices may include, for example, personal computers, laptop computers, tablet computers, smart phones or any electronic or computing apparatus specifically designed to perform computation of electronic or computer signals.

The computing system 112 is arranged to provide a number of functions to the gaming apparatus 100 including the control and operation of a camera system 118, processing information received from sensors 120 and the tracking system 116 to direct the camera system 118 at the projectile 104, player/user 102 or the target 108 and to visually capture the game play of the user 102 when the user 102 is playing a game or performing an activity on the gaming platform 106. Additionally, the computing system 112 may also operate the game by receiving gaming inputs via an interface from the player, setting up and operating the game in accordance with the required rules of play and order of play, monitoring for player activity, point scoring, storing of gaming or gaming related data, administering the rules and game play operations of a game, broadcasting data relating to the status of the games and any multimedia data created from the game and communicating with other players or gaming servers to operate multiple player or remote based gaming services. This is performed by the computation processor of the computer system 112 which would also access the communication gateway 114, the tracking systems 116, the camera systems 118, sensors 120, display systems 122 and a user interface 124 for receiving player input so as to operate and facilitate the game for the player 102.

In this example embodiment, the computing system 112 is also arranged to handle multiple functions associated with the game played by the player 102 and as shown, also uses and control a camera system 118 to monitor and obtain game related data relating to the player's game play. This game related data may include, for example:

- One or more optical images or videos (with sound) of the player 102, their position, posture, pose and stance when they begin, during and after their actions as part of the game play. These images or videos can be shown to the player, spectators and other players, or alternatively, can be processed to determine a strategy, posture or methods of game play by the player.
- One or more optical images or videos (with sound) of the projectile 104 as it is delivered which in turn may be processed to track the projectile 104 after it has been thrown or delivered by the player 102 towards a target or goal 108. The processing which takes place so as to allow the images or videos to be processed by the computing system 112 to track or predict the position in which the projectile 104 may land as well as the speed and direction of the projectile 104 when it reaches its final position;
- One or more optical images or videos (with sound) of the gaming platform 106 so as to provide visual representation or data modelling of the game play in progress with respect to the platform 106; and,
- One or more optical images or videos (with sound) of the space surrounding the gaming platform 106 so as to capture the atmosphere and surroundings of the gaming platform 106, including spectator reactions.

As shown in FIG. 1, the camera system 118 may include multiple cameras 126 each arranged to capture images or videos (with sound) of the gaming platform 106, player 102, projectile 104, target 108 and the surrounding environment. Examples of the camera system 118 will be described below with reference to FIGS. 2A to 2C, but may include high definition (HD) cameras that are placed in various angles proximate to the gaming platform 106 to best capture the images and videos necessary for the game in which the gaming apparatus 100 is operating. In an example where the game is a game of darts, the cameras 126 may be directed towards:

- the target (the dartboard) 108 so as to see where the dart 104 lands;
- the player 102 from a top, front, rear and side profile so as to track their posture, position and dart delivery technique;
- the dart (the projectile) 104 so as to track the path of the dart 104 as it is thrown by the player 102 towards the target 108, or anywhere else the player 102 throws the dart 104; and,
- the gaming platform 106, so as to form an overview (or bird's eye view) of the gaming platform 106 itself, including player 102, target 108 and projectile 104 and the surrounding environment.

Preferably, the camera system 118 may be arranged to be controlled by the computing system 112 such that individual cameras of the system 118 can be manipulated by the computing system 112 to track, zoom or follow a projectile, user or target during game play or gaming interval. This is advantageous as close up images (zoomed in) or tracking images (streams of images of a moving object) of the projectile, target, or user can be captured, processed and broadcasted, which in turn can improve the user experience as well as spectator enjoyment of the game.

In some preferred examples, during a game session, the computer system 112 may control one of the cameras to be directed to a target area where a projectile, such as a dart, may be delivered by a user. In one example, the camera may zoom in on the target area so as to capture a general frontal image of the target. As the projectile is delivered by the user, the computer system 112 may detect that the projectile has been delivered by the user, and immediately wait for the subsequent impact of the projectile with the target. Once the projectile impacts the target, the computer system 112 may then control the camera to zoom in on a specific segment of the target proximate to where the projectile had impacted the target.

The computer system may be able to determine where the projectile had impacted the target through a number of different procedures and methods. Such procedures, which are explained further with reference to FIGS. 5A to 5C below, may include, without limitations:

- by use of sensors or image tracking methods which track the path of the projectile immediately before and after once it has been delivered by the user. Such sensors may include the use of infrared sensors which senses a signature, marker or general shape of the projectile as it is delivered by the user;
- a prediction method whereby the computer system 112 can analyse the game play strategy, score, habit, history or skills of the user/player and predict the approximate location of where the projectile is likely to impact the target. In turn, with this prediction, the computer system 112 can direct the camera to point or zoom in on a segment of the target where this predicted impact segment is likely to be; and,
- by use of impact sensors on the target which senses where on the target the projectile has impacted the target and in turn directing or zooming the cameras to the area of impact, or by the editing of a continuously recording stream of images to only show the portion of the image stream which shows the impact process.

In addition to the function of the computer system 112 to capture and zoom in on a target, the computer system 112 may also be able to control the camera system 118 to capture the motion images of the projectile and user during the gaming session. As mentioned above, the computer system 112 may be able to track the path of the projectile by various methods, including by sensors or processing of images captured by the cameras or by prediction of where the user may deliver the projectile during game play due to historical play strategies or scores. In turn, this tracking data may allow the computer system 112 to control the cameras to follow a projectile as it is delivered by a user towards the target, resulting in motion images of a projectile as it is moving towards the target. Such images may be processed to determine specific gaming data, including actual path, as well as aerodynamic movements of the projectile (e.g. spins, rotations) which can be used to determine the skill and strategy of the user, or the images may also be shown on a multi-media platform to enhance the experience of players and spectators.

These images and videos may in turn be processed by the computing system 112 to determine specific gaming data and results such as whether the player has fouled the throw due to crossing the oche 110, the point in which the dart 104 has hit the target 108 and thus the player score can be calculated, pre-determination of the path in which the dart 104 will travel, pre-determination of which segment of the target 108 would the projectile 104 impact upon, prediction of gaming results or strategies or for education or practice to improve on game results or player skills. Other sensor data as obtained from various sensors 120 such as air flow rate and direction, temperature, humidity and noise levels may also be incorporated into the computer 112 for analysis to determine the condition of the player 102 or any data relating to the game play itself. Rules may be set by an operator of the gaming apparatus 100 to create an enjoyable gaming environment.

In some examples, the images and videos, particularly of the user 102, may also be processed with a facial recognition system 128 so as to identify the player 102 or to determine the mood of the player 102. In certain games, such as darts 104, it is not unusual to have multiple players 102 in a team participate in a game or that individual players 102 may take multiple turns or repeat turns due to a specific score or result. In these instances, a facial recognition system 128 could automatically determine the identity of the player 102 for scoring and data recordal purposes, without the necessity of the player 102 to identify his or herself through the interface 124 of the gaming platform 106 on each attempt. This is advantageous in that the gaming process can be improved and made more seamless, in turn improving the experiences for the players 102 and the spectators.

Preferably, the optical images or videos may also be stored or broadcast to other gaming systems or multi-media systems such that other players or spectators of the games can also watch the game play. These images and videos, together with any processing or analysis of these images and videos may be sent by the computing system 112 via a communication gateway 114 to a cloud based server 130, which may in turn transmit these images, videos and data to other connected gaming systems or multi-media systems 132 for game play or broadcast. In this regard, the gaming system 100 may also include a display system 122 which can include a plurality of display apparatuses such as television screens (LCD screens etc) 134, holographic displays 136, or projectors 138. These display apparatuses may be arranged to display the captured images, videos and gaming data so as to enhance the experience for the player 102, broadcast the player's gaming techniques and results to the local or remote audiences or to share the game play with other players that may be competing with each other via remotely located, but connected gaming systems 132.

In some example embodiments, the display system 122 may use a projector 138 or laser projection system 140 to project signals or images onto the gaming platform 106, including the player 102, target 104 or the platform 106 itself. This is particularly useful as such light beam, images or text can create "guidance" to the player when the game is played and may be useful as part of a training system for the player, to illustrate a specific result for the spectators, or to create a special atmosphere. As an example, the target 108 can be a blank board and using a projector 138 or laser projector system 140 a specific pattern that can be projected onto the blank board for the specific game. Thus in a game of darts, for example, the dart board 108 can be projected onto the blank board whilst the camera system 118 is arranged to capture where the dart 104 has landed. In turn, the computer system 112 can determine based on the capture images of the dart 104 and the place of projection of the dart board 108, the score of the dart 104 that was landed by the player. Advanced examples of the game may also mean the projection on the dart board 108 can vary in pattern, thus increasing the challenge of the dart game for the player 102.

Figure 2A:
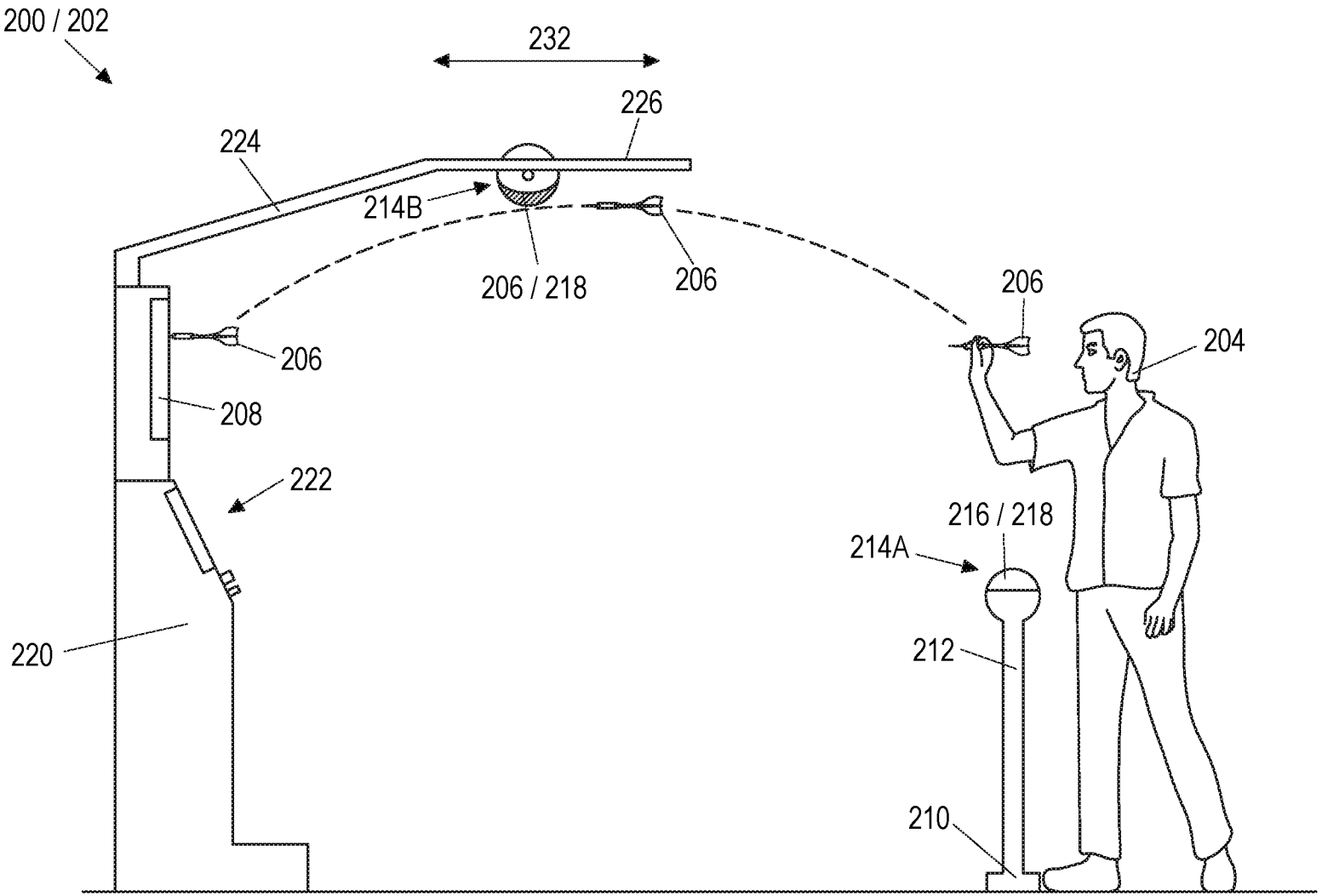
FIG. 2A is a side view of a gaming apparatus in accordance with one embodiment of the present invention.
Figure 2B:
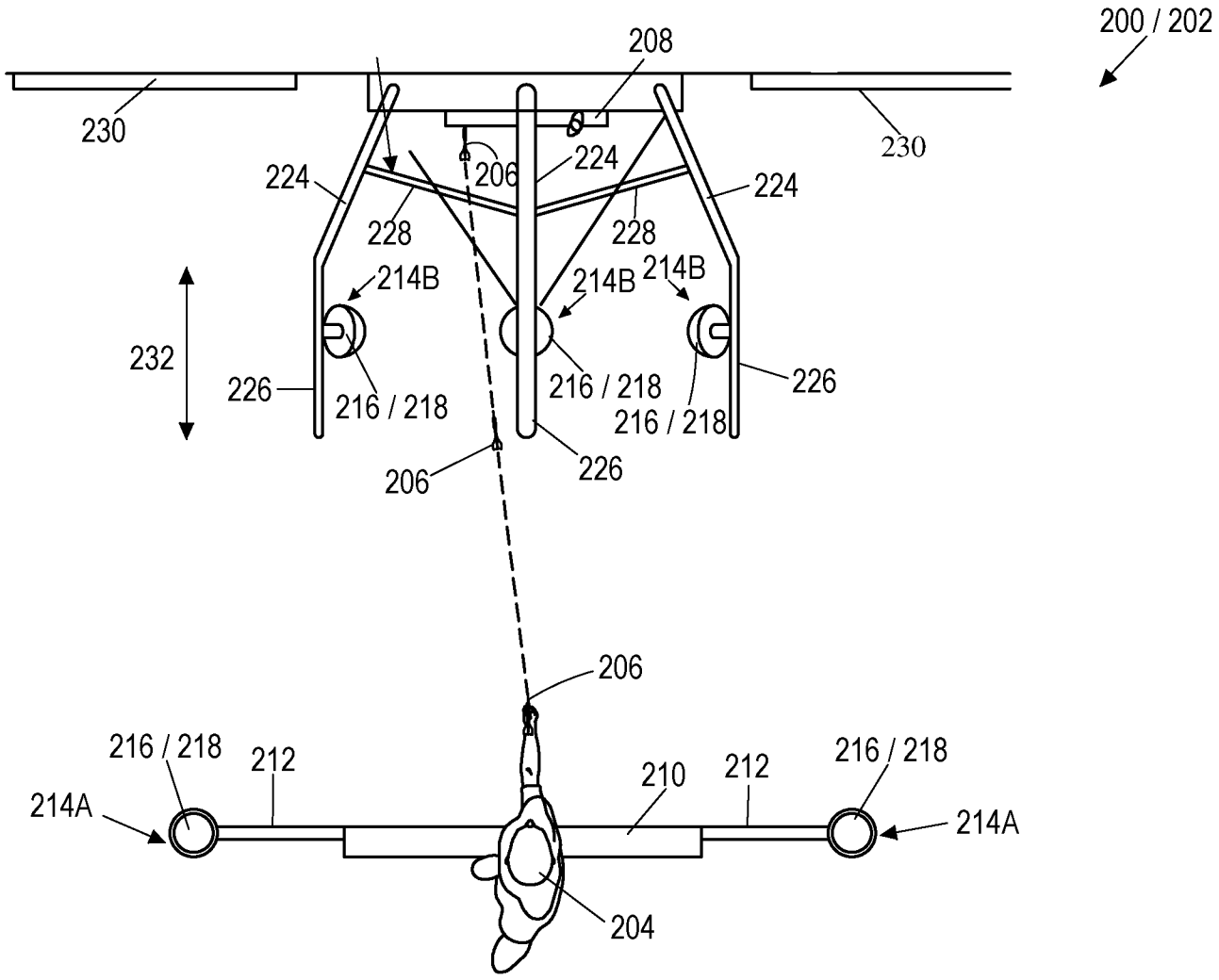
FIG. 2B is a top view of the gaming apparatus of FIG. 2A.
Figure 2C:
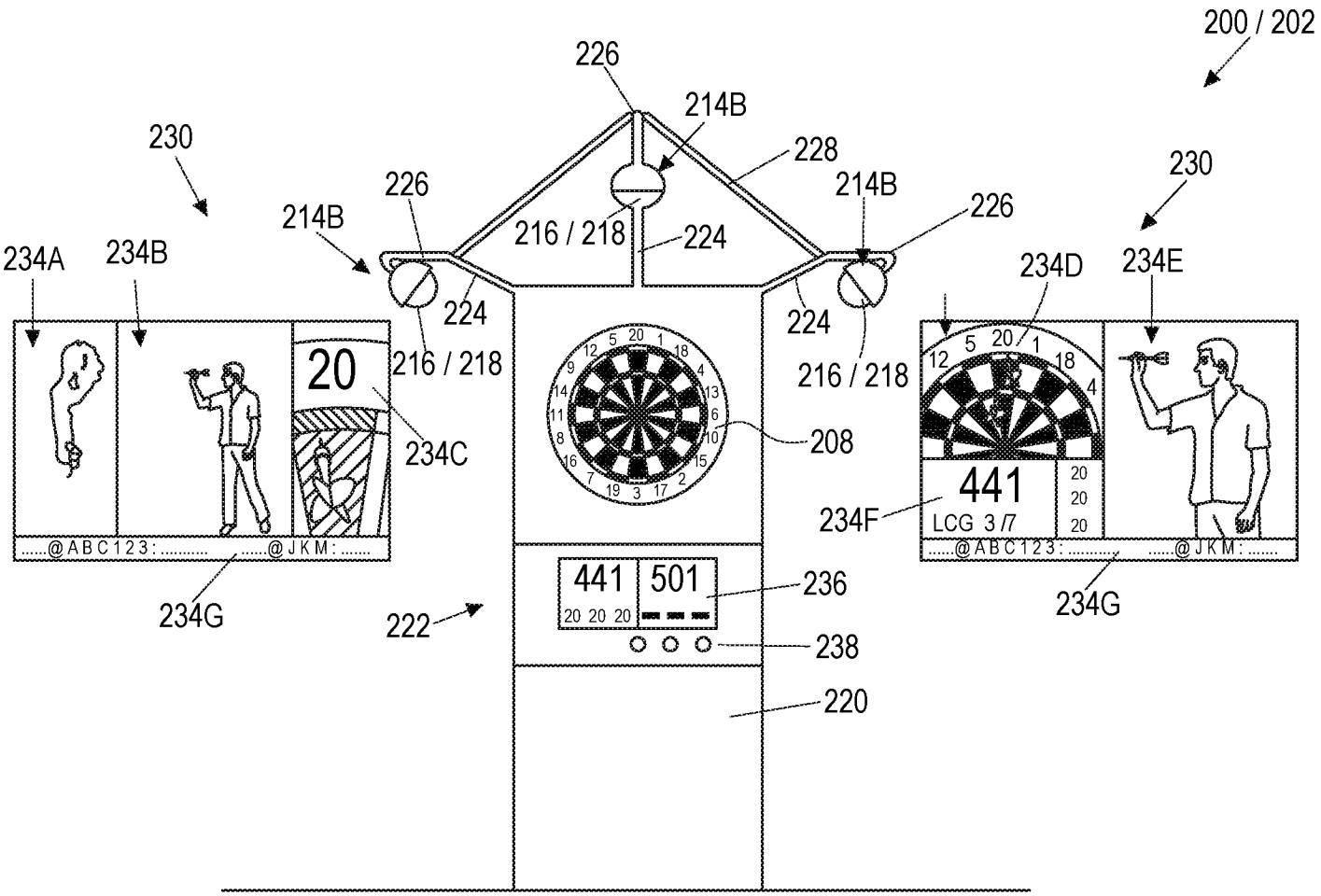
FIG. 2C is the front view of the gaming apparatus of FIG. 2A.

With reference to FIGS. 2A to 2C, there is illustrated an example embodiment of a gaming platform 202 of a gaming apparatus 200. In this example, there is shown a dart gaming platform 202 that allows a user or player 204 to throw a dart 206 to a goal/target such as a dart board 208 at a predetermined distance away therefrom.

As shown, the dart gaming platform 202 includes an oche 210 arranged at a distance away from the dart board 208. The two ends of the oche 210 are arranged with a pair of poles 212. On the top of each pole 212, a housing 214A is arranged to receive at least one camera 216 and/or at least one sensor 218 to capture images of the player 204, the dart 206, the gaming platform 202 as well as to track the position of the dart 206. Preferably, the cameras 216 and the sensors 218 are configured to be rotatable such that the cameras 216 and the sensors 218 can be directed to different angles for capturing and tracking purposes.

In this example embodiment, the dart gaming platform 202 further includes a computing device 220 placed at a distance away from the oche 210. The computing device 220 may provide a number of functions such as the control and operation of the camera system, sensor system, facial cognition system, display system, tracking system and to visually capture the game play of the player when the player is playing a game or performing an activity on the gaming platform 202. Additionally, the computing device 220 may be arranged with a control module 222 to operate the game by monitoring for player activity, point scoring, receiving gaming inputs from the player etc.

As shown, a target or goal in the form of a dart board 208 is arranged above the computing device 220 of the gaming platform 202 for receiving the dart 206 thrown by the player 204. On top of the dart board 208, there is provided a plurality of cantilevers 224 with rails 226 extended therefrom. Each of the rails 226 is arranged with a housing 214B which receives at least one camera 216 and/or at least one sensor 218 for image capturing and tracking purposes. In this way, in addition to being rotatable, the housings 214B are movable along the rails 226 through different mechanisms such as a pulley mechanism or a wheel-rail mechanism. In turn, the cameras 216 and/or the sensors 218 inside the housings 214B may follow the movement of the dart 206 and to provide various camera angles during the image capturing and path tracking of the dart 206. Each of the cantilevers 224 is further connected to each other through a supporting brace 228 so as to minimize any vibration from the cantilevers 224 during the movement of the housings 214B along the rails 226 which in turn maximizing the image capturing quality.

Further in this example embodiment, the dart gaming platform 202 may include a plurality of display apparatuses 230 such as television screens (LCD screens etc), holographic displays or projectors being arranged to display gaming information such as captured images and the gaming results so as to enhance the experience for the players.

As shown in FIGS. 2A and 2B, there is a player 204 standing behind an oche 210 of a dart gaming platform 202 ready to throw a dart 206 towards a dart board 208. The oche 210 may be a physical line being made of plastic, nylon, metal etc. or may be an image projected from a projector. In one example, the oche 210 is a physical line that may be raised automatically by the computer or manually by a player or formed deliberately as part of the gaming platform 202 to a certain position according to the player's needs so as to guide the player standing behind the oche 210 during the game more conveniently. In this example, the oche 210 is a rectangular bar that is arranged as a curb on the floor of the gaming platform 202.

Preferably, the oche 210 is connected to a computing device 220 arranged on the gaming platform 202 such as a personal computer, laptop computer or smart phone etc. through a wire or wireless connection so as to transmit specific gaming data to the computing device 220 to process, which in turn providing the player 204 specific gaming information such as whether the player 204 shall be fouled as a result of crossing the oche 210.

At the two ends of the oche 210, there is a pair of poles 212 with a housing 214A being arranged on the top of each pole 212. In one example, each of the housings 214A is arranged to receive a camera 216 and a sensor 218 and is configured to be rotatable. The housings 214B are also arranged on the rails 226 extended from the cantilevers 224 of the dart gaming platform 202 as shown in FIGS. 2B and 2C. Each of the cantilevers 224 is further connected to each other through a supporting brace 228 so as to minimize any vibration from the cantilevers 224 during the movement of the housings 214B along the rails 226 which in turn maximizing the image capturing quality. Similarly, each of these housings 214B is arranged to receive a camera 216 and a sensor 218. In addition to being rotatable, these housings 214B are movable along an axis 232 that is parallel to the rails 226 so that the cameras may capture images at various angles.

In this example, upon throwing the dart 206 by the player 204, the cameras 216 arranged on the poles 212 may be directed towards the player 204 from a rear and side profile whereas the cameras 216 arranged on the cantilevers 224 may be directed towards to the player 204 from a top and front profile to track his/her posture, position and dart delivery technique. In some example, at least one of the cameras 216 on the poles 212 and/or on the cantilevers 224 may be directed to the dartboard 208 so as to capture image of where the dart 206 lands. In a further example, at least one of the cameras 216 on the poles 212 and/or on the cantilevers 224 may be directed to the dart 206 as it is thrown by the player 204 towards the dartboard 208 or anywhere else the player 204 throws the dart 206. The images captured may be transmitted to the computing device 220 to process and generate gaming information such as the path of the dart.

In some example, each of the housings (214A, 214B) may also receive a sensor 218 such as an infrared sensor or a color sensor or a sensor to enable computer aided object recognition for tracking the path of the dart. The sensors 218 may read an image, a color mark or an infrared signal from the dart 206 and transmit the signal to the computing device 220 for processing. In turn, the computing device 220 transmits the processed signal to the cameras 216 on the poles 212 and/or on the cantilever 224 such that the cameras 216 can be directed towards the dart 206 more accurately.

The captured images as mentioned above may be shown on a display system 122 and may be broadcasted through a communication gateway 114. With reference to FIG. 2C, the dart gaming platform 202 may include two display apparatuses 230 arranged to display the captured images, videos and gaming data. The display apparatus 230 may be implemented in the form of television or computer screens such as LCD screens etc., holographic displays or projectors. The display apparatuses 230 may be connected to the computing device 220 which sends the captured images and videos to a cloud based server 130 via the communication gateway 114 so as to broadcast the captured images, videos and gaming information. In this example, the display apparatuses 230 may show an overhead image of the player/opponent (234A), a side image of the player/opponent (234B), a zoom-in image of dart and dartboard (234C), an image of the opponent's dartboard (234D), a zoom-in facial image of the opponent (234E), and opponent's score (234F). Additionally, through the cloud based server 130, spectators may provide their comments online when enjoying the game show. The comments (234G) may also be shown on the display apparatuses 230 which may allow the player to take them as a reference for the game play. It is also appreciated that the information shown on the display apparatuses 230 may be arranged according to the player's needs.

As shown in FIG. 2C, the dartboard 208 is arranged above the control module 222 of the computing device 220. In one example, the dartboard 208 is a soft-tip fibre board, a steel-tip bristle board or any other dartboard appreciated by a skilled person. The diameter of the dartboard may be of 13'5", 15'5" or 17¾ inches or other suitable sizes. In another example, the dartboard 208 may be a blank board with a specific pattern projected thereon. Additionally, the dartboard 208 may include a plurality of sensors operably connected with the computing device 220 so as to detect where the dart 206 is landed and transmit the signal to the computing device 220 to process. In turn, the computing device 220 calculates the scores which may be displayed on the control screen 236 of the control module 222.

The control module 222 is operably connected to the computing device 220 and the dartboard 208 so as to control the operation of the gaming platform 202 as well as providing some brief gaming information. In this example, the control module 222 includes a control screen 236 for displaying information and a control panel 238 in the form of a plurality of buttons. As shown, the control screen 236 may be configured by the buttons 238 to show the scores of the player 204 and the opponent as well as the three most recent points that the player 204 and the opponent get. In one example, the buttons 238 may be further arranged to perform other functions such as activating and switching off the gaming platform, switching gaming modes, and controlling playback of captured images/recorded videos. It is appreciated that other configurations of the buttons 238 are also possible.

Figure 3:
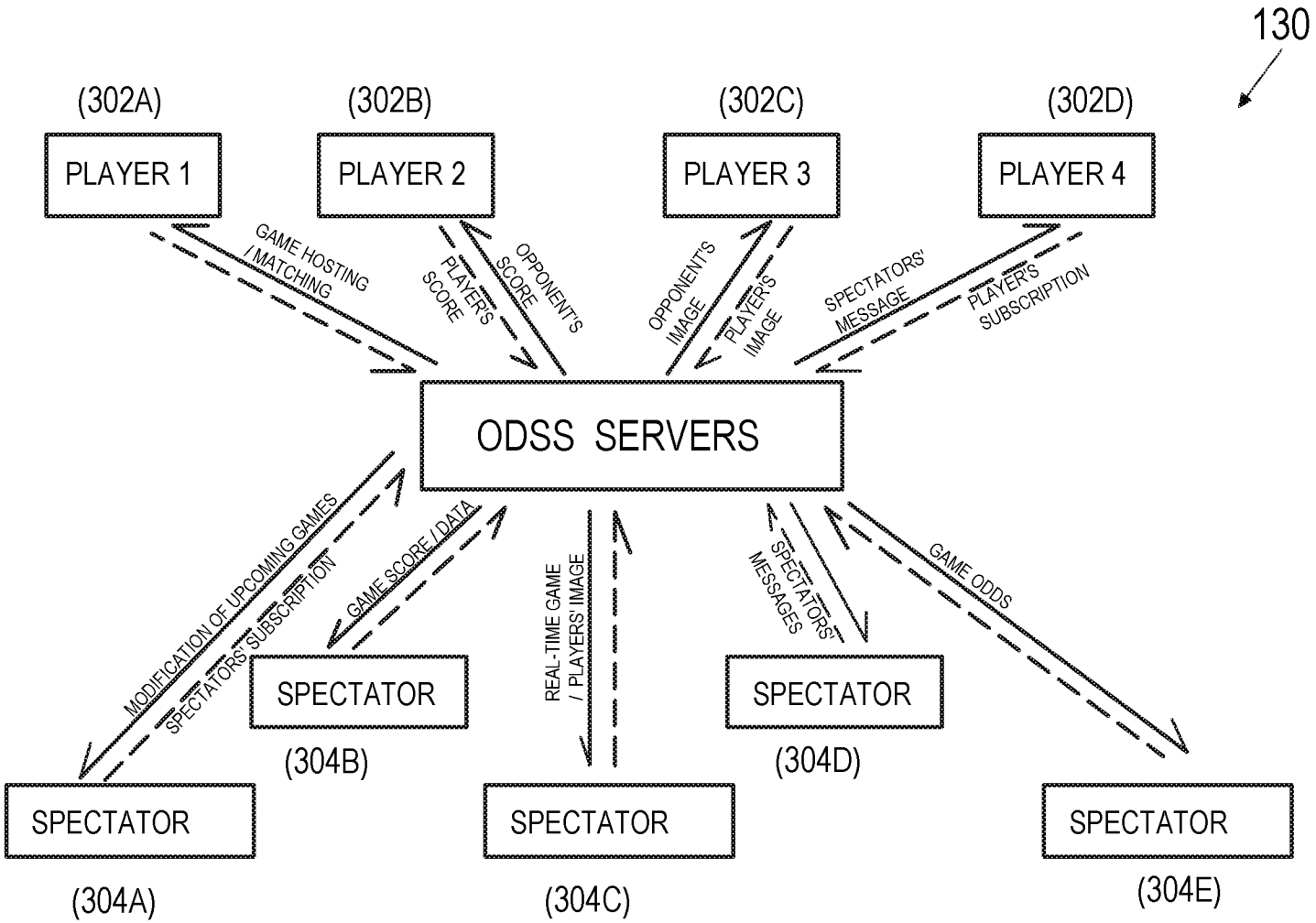
FIG. 3 is a block diagram illustrating the information flow of the cloud based server of FIG. 1.

With reference to FIG. 3, there is illustrated an example embodiment of the cloud based server 130 of FIG. 1. As shown, the cloud based server 130 acts as an information hub to allow different information to be exchanged between a plurality of users/players (302), a plurality of spectators (304), or a combination thereof that are operating the gaming apparatus 100 and/or other multimedia devices to receive broadcast images, videos and data related to the game.

In one example, there may be four players (302A, 302B, 302C and 302D) operating the gaming apparatus 100. The four players (302A, 302B, 302C and 302D) may be arranged in the same room to share one gaming apparatus 100, or alternatively the players (302A, 302B, 302C and 302D) may be arranged in different locations to operate their own gaming apparatus 100 and share gaming information through the cloud based server 130. This may be particularly advantageous as the players (302A, 302B, 302C and 302D) in different locations may join the same game in a virtual gaming room created on the cloud based server 130, which allows the players (302A, 302B, 302C and 302D) to compare their scores at any time or compete with each other or as teams.

As shown in FIG. 3, there are four players (302A, 302B, 302C and 302D) arranged in different locations operating their own gaming apparatus 100 that is connected to the cloud based server 130. One of the players, such as player 302A may host a game/match on his gaming apparatus 100. At the same time, a virtual gaming room will be created in the cloud based server 130. Players (302B, 302C and 302D) who are operating the gaming apparatus 100 in the same or different locations may search and join that particular gaming room through the cloud based server 130. In one example, the game host such as player 302A may apply different filters to select the desired opponents whilst other players (302B, 302C and 302D) may also apply different filters to search their desired opponents. Such filters may include acquaintanceship between the players 302, number of games won, scoring range, number of games lose, playing frequency/experience, gaming locations etc. In some example, the player 302D may subscribe to follow a particular player of interest through the cloud based server 130.

During the game play, the computing device 112 of the gaming apparatus 100 will transmit all the gaming information to the cloud based server 130 and share these information among the players (302A, 302B, 302C and 302D). The information may include opponents' scores, opponents' images showing their posture or position, or images/videos of the dart path etc. The players (302A, 302B, 302C and 302D) may use this information as a reference for adjusting the playing strategy during the game.

Alternatively, users of the gaming apparatus 100 may operate the apparatus 100 by not joining the game as hosted by the players (302A, 302B, 302C and 302D). Rather, the users may act as a spectator 304 to enjoy the game through the cloud based server 130.

In one example, the spectator 304A may search for a desired game room using the filters as mentioned above. The spectator 304A may subscribe to follow a game play of interest through the cloud based server 130. When the game play of interest is hosted, the cloud based server 130 will send a notification to the spectator 304A via means of, for example, email, instant messaging, tweet or scheduler etc. such that the spectator 304A will not miss the game play.

During the game, the information that is transmitted from the computing device 112 of the players' (302) gaming apparatus 100 to the cloud based server 130, may also be transmitted to the computing device of the spectators' (304) gaming apparatus or multimedia devices and displayed on the display apparatuses 122 or the screens or projectors of the multimedia devices. Therefore, the spectators 304 will obtain the real-time gaming information through the cloud based server 130. In addition, the spectators 304 may input messages during the game play and share among the players 302 and other spectators 304. In some example, the cloud based server 130 may offer game odds for the spectators 304 to have a bet on the game.

Figure 4:
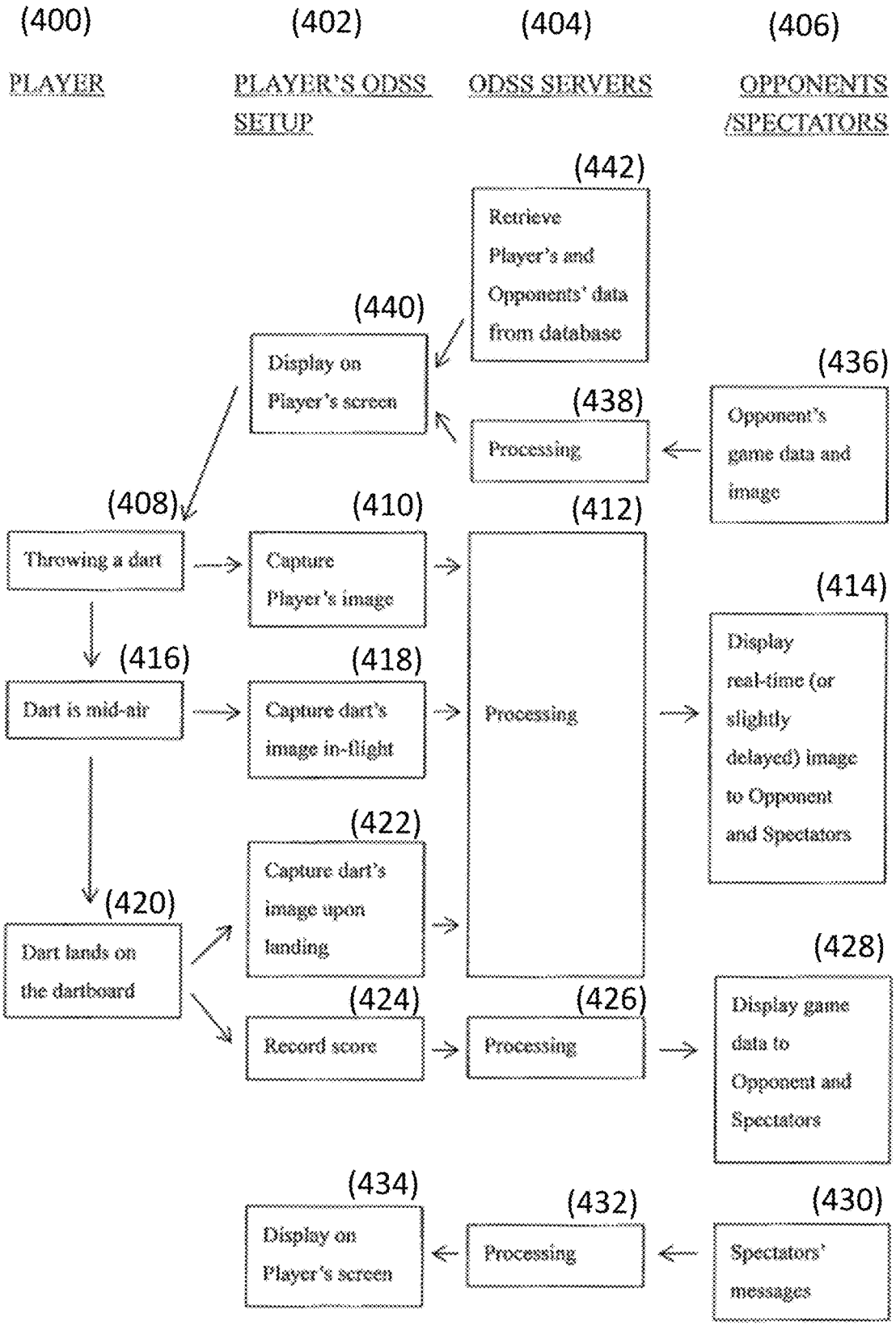
FIG. 4 is a block diagram illustrating the image and data processing of the computing device of FIG. 1.

With reference to FIG. 4, there is illustrated a block diagram showing the image and data processing of the computing device 112 of FIG. 1 during a game play.

As shown, the block diagram is divided into four columns, each of which (from left to right) represents the action of the player (400), the computing device 112 of the gaming apparatus 100 (402), the cloud based server 130 that is connected with the computing device 112 (404), and the action taken or information received by the opponents or spectators (406).

In one example, a player starts playing a game by throwing a dart 104 towards a dartboard 108 (408). Upon which, the computing device 112 controls the camera system 118 of the apparatus 100 such as the cameras 216 arranged on the poles 212 and the rails 226 extended from the cantilevers 224 as shown in FIGS. 2A to 2C, to direct towards the top, front, rear and side profiles of the player so as to capture the posture and position of the player (410). These images are transmitted to the cloud based server 130 for storing or editing (412) and in turn are transmitted to the opponents/spectators so as to display real-time images and videos to them (414).

After the player 102 throws the dart 104, where the dart 104 is in mid-air (416), the computing device 112 recognizes the dart 104 based on the images captured in process (410) or the signal received from the sensors 120 such as a color or an infrared sensor 218 as described in FIGS. 2A to 2C. In turn, the computing device 112 controls the camera system 118 to follow and capture the images of the dart 104 in-flight (418). These images are transmitted to the cloud based server 130 for storing or editing (412) and then being transmitted to the opponents/spectators so as to display real-time images of the dart path to them (414).

Upon the dart 104 lands on the dartboard (420), the computing device 112 controls at least one of the cameras 126 in the camera system 118 to focus on capturing the images of the dartboard 108 (422) whilst other cameras 126 in the camera system 118 are still capturing images of the dart 104 in-flight (418). In turn, the computing device 112 may receive two sets of images, one focusing on the dart 104 in-flight (418) whereas another one focusing on the dartboard 108 and the dart 104 upon landing (422). The computing device 112 transmits these images to the cloud based server 130 for storing and manipulation (412) followed by displaying the images of how the dart 104 in-flight landing on the dartboard 108 to the opponents/spectators (414). In addition, upon the dart 104 landing (420), the computing device 112 receives signals from the sensors on the dartboard 108 so as to record the score point of the player 102 (424). The recorded score point is also transmitted to the cloud based server 130 for processing (426) and being shown to the opponents/spectators (428).

In some example, the spectators may input messages to discuss with other spectators online or input comments for the game play through a communication gateway connected to the cloud based server (430). As shown, the messages and comments inputted by the spectators are directed to the computing device 112 and transmitted to the cloud based server 130 for processing (432) followed by showing to the player 102 (434) as described with reference to FIG. 2C.

During the opponents' turn of the game play (436), the gaming data such as the images of the opponents and the dart 104 is transmitted from the computing device 112 to the cloud server 130 for processing (438) as described above such that the data can be shown on the gaming apparatus of the player 102 (440). In addition, in one example, the cloud based server 130 may retrieve data such as playing history or performance history etc. of the player 102 and the opponents (442) and display such data to the apparatus 100 through the control module 222 as described in FIGS. 2A to 2C (440).

In some examples, to capture a close-up image of the projectile upon impact of the target but where real-time tracking and image capture cannot be achieved, a slightly delayed image will be captured and transmitted to opponents and the spectators (414). This method for displaying a zoomed-in and focused image of the position on the target where projectile has landed without real-time tracking of the position of the thrown projectile is achieved by (1) an image of the entire target is captured continuously; (2) sensors on the target would identify the position where the projectile has landed; (3) the computer system 112 would retrieve the video recorded a moment ago when the projectile was making impact into the target and enlarge the image of the area of the target where the projectile has landed; (4) such processed delayed video image would be transmitted to the opponent and spectators with unnoticeable short delay such that such video image would appeared to be shown in real-time to the opponent and spectators who are not present at the scene with the player.

Figure 5A:
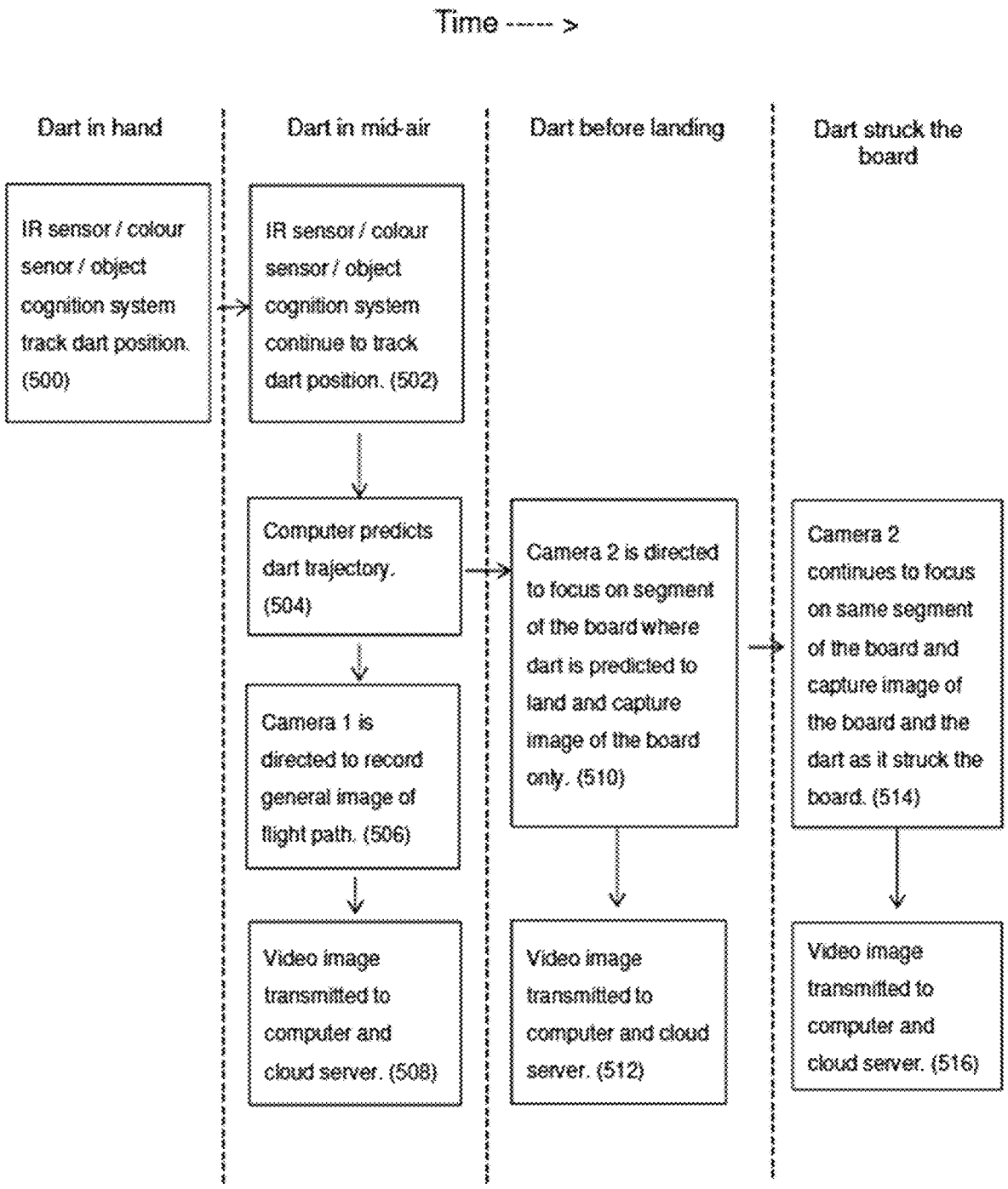
FIG. 5A is a flow diagram illustrating a tracking and video capture method based on IR sensing/colour sensing/computed aided-object recognition in accordance with one example embodiment of the invention.
Figure 5B:
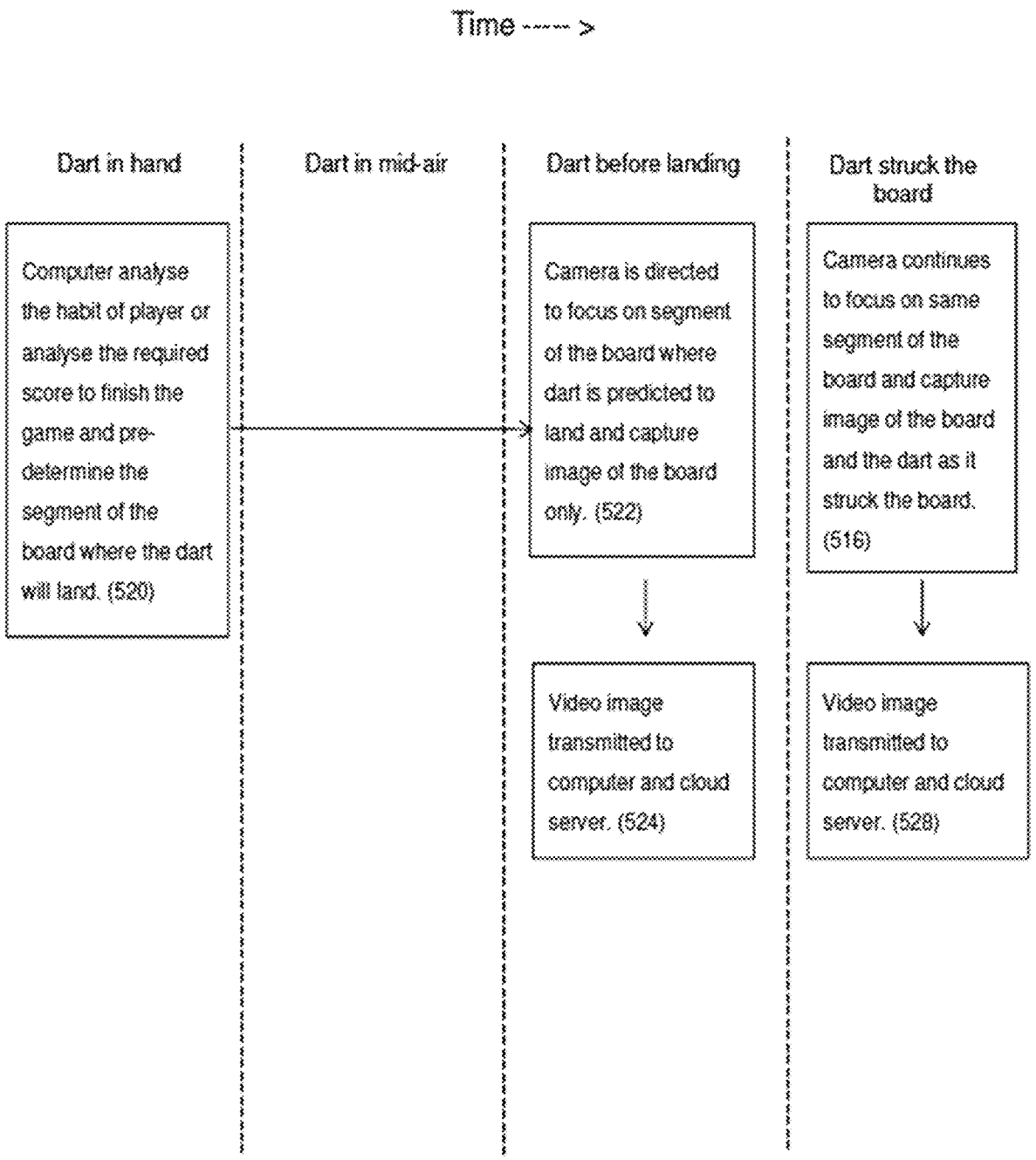
FIG. 5B is a flow diagram illustrating a tracking and video capture methods based on a pre-estimation of throwing habit and usual game route in accordance with one example embodiment of the invention.
Figure 5C:
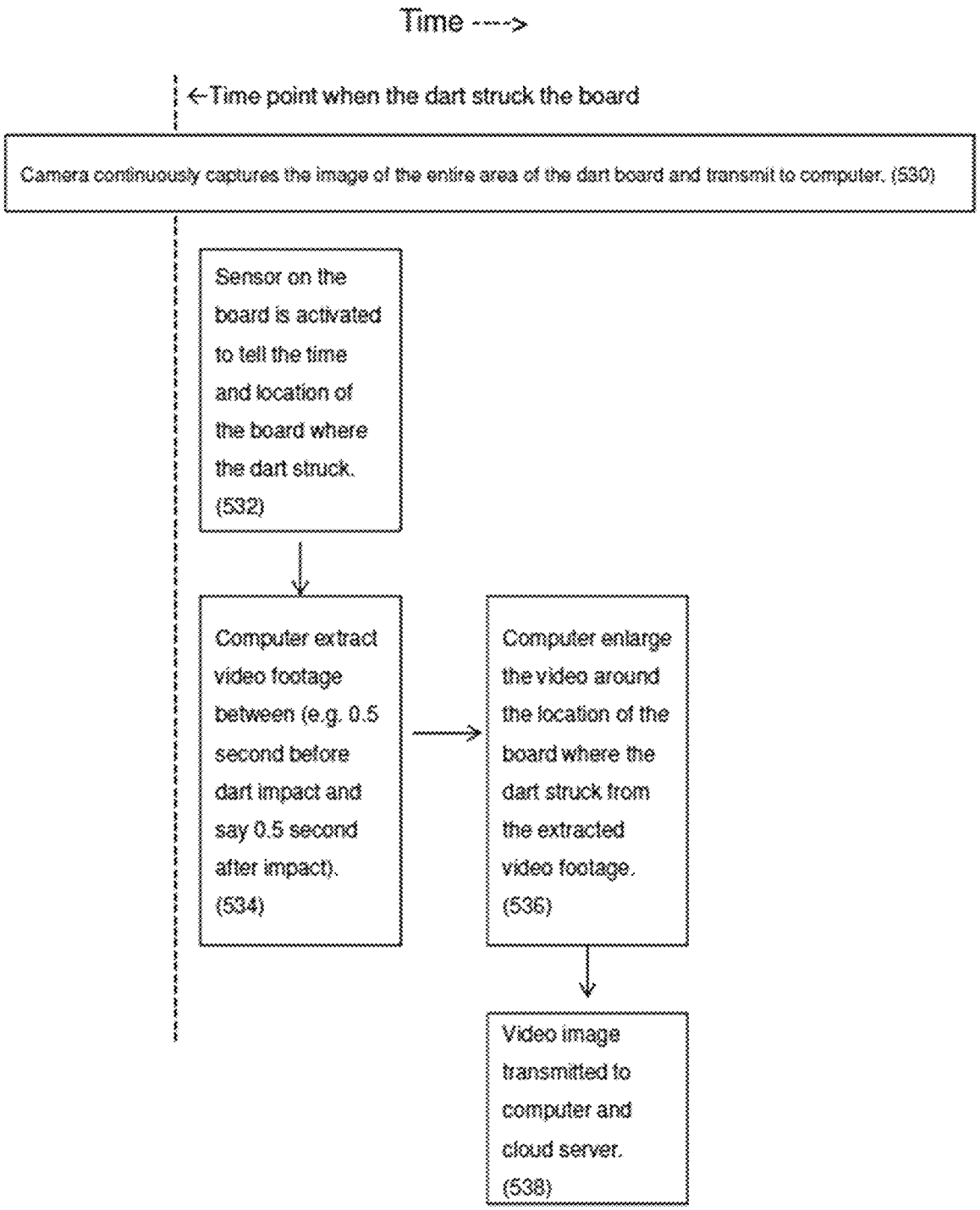
FIG. 5C is a flow diagram illustrating a delayed video capture methods in accordance with one example embodiment of the invention.

With reference to FIGS. 5A to 5C, there is illustrated a series of flowcharts which shows example methods and procedures performed by the computer system 112 to operate the camera system 118 during an operation of a dart or any throwing game. These procedures may be advantageous as the computer system 112 may be able to capture superior and more action based images or stream of images of the dart as it is delivered by the user, its flight path and its impact with a target. In turn, by capturing and showing such images, the spectator and player enjoyment of the game is increased.

FIG. 5A shows an example flow chart of the procedures undertaken by the computer system 112 where the tracking of the dart (or other projectile) is performed by use of IR sensors, colour sensors or computer aided object recognition methods.

As show in FIG. 5A, when a user of player of a dart game is in position with a dart in their hand, a sensor or camera in communication with the computer system 112 begins to capture a signature of the dart so as to recognize the dart is in position (500). This process can be performed by object recognition methods, which can process an image to determine the location and presence of a dart as based on an outline or shape, or by optical sensors such as Infrared (IR) sensors or colour sensors that can detect the dart within a specific position based on the colour, pattern or signature (either visual or by the reflection of light or heat).

Once the presence of the dart as well as its position is detected or determined, the computer system 112 can then track the dart position throughout the throwing process (502), starting with an initial position when it is in the user's hand, to when it leaves the user's hand, its trajectory and its impact with the target or any other surface. This can be performed by the computer system 112 by continuously determining the position of the dart throughout the entire period of game play.

As shown in FIG. 5A, in this example, the computer system 112 may also predict the trajectory of the dart (504). In one example, this is performed by analysing the initial position and early path of the dart as it is delivered by the user. As the initial position and early path of the dart will allow the computer system 112 to determine the velocity of the dart as well its direction of travel, a trajectory can be calculated as a prediction to where the dart will land. This is particularly useful as the predicted trajectory can then be used to control the camera system 118 such that the camera can continuously track and follow the moving dart (506) which in turn produces a stream of images of the dart as it moves along its flight path. This stream of images can then be transmitted or broadcast for spectators and other players, or stored for subsequent records or further processing (508).

In addition to the predicted trajectory being used to control the camera system 118 to continuously track the dart as it moves along its flight path, the predicted trajectory may also allow the computer system 112 to direct another camera in the camera system 118 to focus on a particular segment of the board where the dart is predicted to impact the target (510). This is advantageous as the camera can be directed to the segment of the target in advance of the dart impacting the target and thus can create a stream of images of the impact event as well as the target after the impact of the dart (514). Such stream of images, particularly when adjusted or processed with respect to time (slow motion etc) can be transmitted remotely to spectators and other players and may be particularly interesting and entertaining to spectators as these image streams provide a sense of live realism and motion to the game (512, 516). This is particularly the case for spectators remote from the player, as they can now experience replays of the dart as it is thrown and when it impacts the target.

As shown in FIG. 5B, there is illustrated a flow diagram of an example set of processes undertaken by the computer system 112 to control the camera system 118 when a pre-estimation of the throwing habit of the user is considered. In some games, such as those of traditional dart games like "Ice Breaker", "Shanghai", "Round the Clock" or "20 to 1", a player may be required to meet a certain score in a certain predetermined order so as to win the game. Thus there is a desire for the player to aim for certain segments of the dart board in order to reach the required points or play to a certain order so as to meet the requirements to win as soon as possible. Accordingly, based on the rules of the game which is being played, the computer system 112 may be able to determine which segment of the target (dart board) is desired by a player to hit with the dart during the gaming process.

In addition, the computer system 112 may also have accumulated statistics and gaming characteristics of particular players, including their throwing technique, power, speed, stance and accuracy. Such statistics and characteristics may also be considered by the computing system 112 together with the desired target segment so as to estimate the desired or likely trajectory or target segment of where the dart will land once it is delivered by the player (520).

In this example, based on these estimations, the computer system 112 may be able to control the camera system 118 to focus on the estimated impact segment of the dart board in advance of the dart impacting the dartboard so as to capture the motion of the dart impacting the dartboard (522). Once the impact takes place, the camera may then be controlled by the computer system 112 to continue to show segment of the dartboard with the dart (526). This is useful as it can be used to assist with confirming the impact point for the player or spectator as well as the score of the throw. In turn, these images may be transmitted, broadcast or stored for subsequent showing to spectators and other players (524, 528).

With reference to FIG. 5C, there is shown another example set of processes undertaken by the computer system 112 to control the camera systems 118 so as to capture images or stream of images of the game play. As shown in this example, the processes are arranged to use a delayed video capture method to capture images of the dartboard during the game where the camera system 118, with one or more cameras being arranged to continuously capture the image of the dartboard for transmission to the computer system 112 (530).

In this example, the dartboard may be arranged with a number of sensors (532), including impact or optical sensors to detect an impact of a dart with the board as well as to the location of the impact. The sensors data may also be monitored over a gaming interval such that a timestamp can be placed on when, during the gaming interval, an impact event of the dart with the board occurred. In turn, when an impact is detected, the timestamp and location can be transmitted to the computing system 112 which would, during the gaming interval, be capturing a stream of images of the dartboard during the gaming interval.

The computer system 112, with the timestamp and location of the impact of the dart with the dartboard can then process this stream of images (536) from the camera systems 118 so as to edit the stream of images which show the impact event (such as by editing to show the images at 0.5 seconds before and after impact). The computer system 112 may also process the images with a focus, enlargement, zoom in or other animations to show where the dart had impacted the board. In turn, allowing these images or stream of images to be transmitted, broadcast or stored for subsequent showing to spectators and other players (538).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A gaming apparatus comprising:

a projectile tracking system arranged to track at least one position of a user-delivered projectile, the projectile tracking system including:

a camera module arranged to capture one or more images of the projectile in at least one position before or after user delivery; and a sensing module arranged to detect the at least one position of the projectile before or after user delivery, the sensing module including:

an infrared sensor arranged to determine the at least one position of the projectile by detecting an infrared signal from the projectile, and a colour sensor arranged to determine the at least on position of the projectile; and a processing unit for receiving tracking data detected by the projectile tracking system to generate projectile data representative of a path of the projectile.

2. The gaming apparatus in accordance with claim 1, wherein the one or more images of the projectile are processed by the processing unit to determine the at least one position of the projectile.

3. The gaming apparatus in accordance with claim 1, wherein the colour sensor determines the at least one position of the projectile by tracking a colour mark on the projectile.

4. The gaming apparatus in accordance with claim 2, wherein the camera module is controlled to capture images of the projectile before or after user delivery.

5. The gaming apparatus in accordance with claim 4, wherein the processing unit is arranged to use the at least one position of the projectile to control the camera module.

6. The gaming apparatus in accordance with claim 5, wherein the processing unit is further arranged to predict at least one predicted position of the projectile.

7. The gaming apparatus in accordance with claim 6, wherein the processing unit uses the at least one predicted position of the projectile to control the camera module to capture the images of the projectile.

8. The gaming apparatus in accordance with claim 6, wherein the processing unit is arranged to determine at least one predicted position of the projectile based on one or more of: the at least one position of the projectile as detected by the sensing module, the at least one position of the projectile as detected by the camera module, and game play data associated with the user.

9. The gaming apparatus in accordance with claim 5, wherein the camera module includes a plurality of motion camera units, each arranged to be controlled by the processing unit to continuously capture images of the projectile.

10. The gaming apparatus in accordance with claim 1, further comprising a gaming platform arranged for the user to deliver projectiles thereon.

11. The gaming apparatus in accordance with claim 10, wherein the projectile tracking system is arranged to be mounted on at least one cantilever adjacent to the gaming platform.

12. The gaming apparatus in accordance with claim 1, wherein the projectile tracking system is mounted on at least one pole adjacent to an oche.

13. The gaming apparatus in accordance with claim 11, wherein the sensing module and the camera module are adapted to be rotatable or movable along a rail extended from the at least one cantilever.

14. The gaming apparatus in accordance with claim 12, wherein the sensing module or the camera module of the projectile tracking system mounted on the at least one pole of the oche is adapted to be rotatable.

15. The gaming apparatus in accordance with claim 1, wherein the processing unit is arranged to predetermine the path of the projectile based on a user's habit and/or usual game route.

16. The gaming apparatus in accordance with claim 1, wherein the processing unit is further arranged to capture images of the user.

17. The gaming apparatus in accordance with claim 1, further comprising a communication gateway to communicate with other gaming apparatuses or multimedia devices.

18. The gaming apparatus in accordance with claim 17, wherein the communication gateway is arranged to communicate with the other gaming apparatuses or multimedia devices to operate a multi-player game with the other gaming apparatuses or multimedia devices.

19. The gaming apparatus in accordance with claim 18, wherein the communication gateway communicates the projectile data representative of the path of the user delivered projectile to other gaming apparatuses or multimedia devices.

20. The gaming apparatus in accordance with claim 19, wherein the communication gateway communicates images of the projectile or images of the user to other gaming apparatuses or multimedia devices.

21. The gaming apparatus in accordance with claim 1, wherein the user delivered projectile includes a dart, ball, disc, ring, stick, bolt or any one or more thereof.

22. A method for operating a game comprising the steps of:

tracking, using a projectile tracking system, a projectile delivered by a player, wherein the projectile tracking system includes:

a camera module arranged to capture one or more images of the projectile in the at least one position before or after player delivery; and a sensing module to detect the at least one position of the projectile before or after user delivery, the sensing module including:

an infrared sensor arranged to determine the at least one position of the projectile by detecting an infrared signal from the projectile, and a colour sensor arranged to determine the at least one position of the projectile;

receiving, at a processing unit, tracking data detected by the projectile tracking system to generate projectile data representative of a path of the projectile; and storing the gaming result.

23. The method for operating a game in accordance with claim 22, further including a step of identifying the player using the camera module.

24. The method for operating a game in accordance with claim 23, wherein the identity of the player and the gaming result is communicated to other players in a multi-player game through a communication gateway.

25. The method for operating a game in accordance with claim 24, wherein the camera module is further arranged to capture images of the player.

26. The method for operating a game in accordance with claim 25, wherein the images of the projectile and the player are communicated to other players in the multi-player game through the communication gateway.

27. The method for operating a game in accordance with claim 26, wherein the camera module is arranged to be controlled to focus on the projectile so as to capture images of the projectile.

28. The method for operating a game in accordance with claim 27, wherein the camera module is controlled using a predicted position of the projectile.

29. A gaming apparatus comprising:

a projectile tracking system arranged to track at least one position of a user-delivered projectile;

a processing unit for receiving tracking data detected by the projectile tracking system to generate projectile data representative of a path of the user delivered projectile; and a gaming platform arranged for the user to deliver projectiles thereon, wherein the projectile tracking system is mounted on at least one pole adjacent to an oche.

30. The gaming apparatus in accordance with claim 29, wherein the projectile tracking system includes a sensing module and a camera module that are adapted to be rotatable or movable along a rail extended from at least one cantilever arranged to be mounted thereon.

31. The gaming apparatus in accordance with claim 29, wherein the projectile tracking system mounted on the at least one pole of the oche includes a sensing module or a camera module that are adapted to be rotatable.

32. The gaming apparatus in accordance with claim 29, wherein the processing unit is arranged to predetermine the path of the projectile based on a user's habit and/or usual game route.

* * * * *